US010322445B2

(12) United States Patent
Cassinath

(10) Patent No.: US 10,322,445 B2
(45) Date of Patent: Jun. 18, 2019

(54) DEVICE AND METHOD FOR HIGH SHEAR LIQUID METAL TREATMENT

(71) Applicant: Zen Cassinath, Repton (GB)

(72) Inventor: Zen Cassinath, Repton (GB)

( * ) Notice: Subject to any disclaimer, the term of this patent is extended or adjusted under 35 U.S.C. 154(b) by 190 days.

(21) Appl. No.: 15/329,966

(22) PCT Filed: Aug. 19, 2015

(86) PCT No.: PCT/GB2015/052409

§ 371 (c)(1),
(2) Date: Jan. 27, 2017

(87) PCT Pub. No.: WO2016/027087

PCT Pub. Date: Feb. 25, 2016

(65) Prior Publication Data

US 2017/0266717 A1 Sep. 21, 2017

(30) Foreign Application Priority Data

Aug. 20, 2014 (GB) ..... 1414810.0

(51) Int. Cl.
*B22D 11/10* (2006.01)
*B22D 1/00* (2006.01)
(Continued)

(52) U.S. Cl.
CPC ..... *B22D 1/005* (2013.01); *B01F 7/183* (2013.01); *B01F 15/00876* (2013.01); *B22D 1/002* (2013.01); *F27D 27/00* (2013.01)

(58) Field of Classification Search
CPC ..... F27D 27/00
See application file for complete search history.

(56) References Cited

U.S. PATENT DOCUMENTS 3,902,544 A 9/1975 Flemings et al.
4,373,950 A 2/1983 Shingu et al.
(Continued)

FOREIGN PATENT DOCUMENTS

CN 101862613 9/2012
CN 102861902 5/2014
(Continued)

OTHER PUBLICATIONS

ISR & WO received in PCT/GB2015/052409 dated Sep. 12, 2015—8 pages.

*Primary Examiner* — Scott R Kastler
(74) *Attorney, Agent, or Firm* — Hard IP LLC

(57) ABSTRACT

A high shear liquid metal treatment device for treating metal includes a barrel, a rotor shaft, rotor fans, and stator plates. The barrel has a longitudinal axis that extends between an upper end and a lower end, and an opening at its upper and lower ends. The rotor shaft is mounted centrally through, and parallel to the longitudinal axis. The rotor fans are mounted along an axial length of the shaft. The stator plates are formed on an inner surface of the barrel and are located between adjacent rotor fans. Each stator plate has at least one passage formed therethrough to allow fluid to pass through the plate; and upper and lower surfaces of each stator plate are formed to be within the minimum distance of an adjacent rotor fan. The minimum distance is between 10 μm and 10 mm. The device allows improved treatment of liquid and semi-liquid metals during processing.

18 Claims, 5 Drawing Sheets

(51) Int. Cl.

| | |
|---|---|
| ***F27D 27/00*** | (2010.01) |
| ***B01F 7/18*** | (2006.01) |
| ***B01F 15/00*** | (2006.01) |

(56) References Cited

U.S. PATENT DOCUMENTS

| | | | | |
|---|---|---|---|---|
| 4,743,428 | A | 5/1988 | McRae et al. | |
| 4,931,060 | A | 6/1990 | Aue | |
| 4,960,163 | A | 10/1990 | Fang et al. | |
| 5,531,425 | A | 7/1996 | Skibo | |
| 6,502,980 | B1 | 1/2003 | Ekstrom et al. | |
| 6,618,426 | B1 | 9/2003 | Ernst | |
| 9,498,820 | B2 | 11/2016 | Fan et al. | |
| 2013/0228045 | A1* | 9/2013 | Fan | F27D 27/00 75/708 |
| 2017/0266717 | A1* | 9/2017 | Cassinath | F27D 27/00 |

FOREIGN PATENT DOCUMENTS

| | | | |
|---|---|---|---|
| CN | 203830008 | U | 9/2014 |
| FR | 1287425 | | 3/1962 |
| GB | 2294209 | | 4/1996 |
| WO | WO2010/032550 | | 3/2010 |
| WO | WO2012/035357 | | 3/2012 |

* cited by examiner

DEVICE AND METHOD FOR HIGH SHEAR LIQUID METAL TREATMENT

This application is a national phase filing under 35 U.S.C. 371 of international patent application no. PCT/GB2015/052409 filed on Aug. 19, 2015 which claims priority to application no. GB1414810.0 filed on Aug. 20, 2014, the contents of both which are incorporated herein by reference in their entirety.

TECHNICAL FIELD

The present invention relates generally to a method and system for semi-solid and liquid metal treatment prior to complete solidification processing of metallic materials, more particularly the invention relates to a device for shearing semisolid and liquid metals.

BACKGROUND OF THE INVENTION

It is well known that liquid metal contains varying amounts of non-metallic constituents, i.e. gas and non-metallic inclusions, and that their presence may give rise to defects in finished products. Many procedures have been proposed for the removal of the gas and inclusions.

Liquid metal treatment prior to solidification processing is necessary for a variety of casting processes including, but not limited to, sand casting, permanent mould casting, high pressure die casting, direct chill casting, twin roll casting and the like for the purposes of grain refinement, melt cleanliness, homogeneous microstructure and homogeneity of chemical composition, dispersing and distributing of both endogenous and exogenous particles.

The existing methods for liquid metal treatment mainly include, mechanical stirring by an impeller, electromagnetic stirring, and some other methods like gas induced liquid flow.

Mechanical stirring by an impeller is a very simple way to treat liquid metals. It only provides moderate melt shearing around the impeller, but causes serious vortex in the liquid metal and serious turbulence near the liquid surface, resulting in severe entrapment of gas and other contaminants from the melt surface. There have been a number of approaches to address such problems.

U.S. Pat. No. 3,785,632 issued to Kraemer et al. discloses a process and an apparatus for accelerating metallurgical reactions. The process includes mechanical stirring at the boundary between the molten bath and the reactant, using a twin-impeller. A centrifugal force component is created when the apparatus starts stirring and causes different curvature towards the margin of the ladle which leads to the acceleration of chemical reaction between the molten metallic material and the reactants.

U.S. Pat. No. 4,743,428 issued to McRae et al. discloses a method of mechanical stirring of liquid metals for producing alloys. The process introduces an agitating device mainly to accelerate the dissolution of alloying elements and slow down the formation of dross.

U.S. Pat. No. 3,902,544 issued to Flemings et al. discloses a continuous process of treating liquid metals by mechanical stirring to obtain semi-solid metallic materials with non-dendritic primary solid. In this process three augers are introduced and located in three separated agitation zones. The augers are more effective compared to the twin blade impeller. The distance between the inner surface of the agitation zone and the outer surface of the auger is kept sufficiently small so that high shear forces can be applied to the materials in the agitation zones.

U.S. Pat. No. 4,373,950 issued to Shingu et al. introduced mechanical stirring by an impeller into direct chill casting process to purify aluminium. Aluminium melt is purified by using a mechanical stirring apparatus to break down dendrites at the interface between the liquid and the solid, and dispersing the impurity released from dendrites into the whole liquid.

U.S. Pat. No. 4,908,060 issued to Duenkelmann discloses a rotary device comprising a hollow shaft and a hollow rotor attached to the shaft for dispersing gas in molten metal. The device introduces inert gas from the top of the shaft and delivers a large volume of inert gas into the melt for degassing of liquid metals.

The inventions discussed above all involve mechanical stirring. They neither provide the high shear rate required for melt conditioning, nor avoid the problems of entrapment of gas and other contaminants from the melt surface.

U.S. Pat. No. 4,960,163 introduces a mechanical stirrer in direct chill casting for achieving fine grain structure and a partition to divide the space in the DC caster into a supply reservoir and a solidification reservoir for avoiding turbulence near the liquid surface in the supply reservoir without weakening the stirring in the solidification reservoir. A certain degree of grain refinement by this invention was achieved but the results were not consistent from batch to batch.

U.S. Pat. No. 6,618,426 issued to Ernst discloses a process of electromagnetic stirring to treat liquid metals. This process used multiple coils with different directions to reduce the turbulence near the liquid surface. However, the shearing rate by electromagnetic stirring is low and the cost of the apparatus is high.

WO 2010/032550 (Nippon Light Metal Co. Ltd) discloses a metal melt refiner for use in a ladling chamber. It is essentially a multi-blade stirrer for degassing and deslagging liquid metals. However it has very little dispersing and distributing power and the whole assembly is not suitable for direct incorporation in existing casting processes.

There are known a method and an apparatus for stirring molten metal in the vessel of the furnace by using an electromagnetic field. The inductor of the running magnetic field is positioned along the vertical wall of the furnace. The furnace contains the passageway for molten metal. The incoming stream of molten metal from the passageway into the vessel is directed mainly along a wall of the vessel. However, the apparatus and the system thereof fail to attain the object of as the intensity of the jet-mixing in the middle of the vessel is lower than along the walls thereof. Thus, for melting of solid metal in the middle of the vessel, additional mechanical-contact stirring is required. Also another way of stirring with the placing of magnetic beads within the molten metal which are then moved in a circular manner thereby stirring the liquid Another shortcoming, that limits the use of said method and apparatus, is the necessity of long-term stoppage of the furnace for dismantling of the inductor and for replacement of plates for removal of slag from the passageway.

In another prior art a furnace is known with a fixed pocket along an end of the furnace, underneath which the inductor is placed. The bottom of the pocket is located flush with the bottom of the furnace. Metal pumps along the pocket and comes in the vessel through a window in the wall of the vessel. The intensity of the stirring in the middle of the vessel is lower than on the sides of the vessel.

As per another prior art the aim of which is to provide an apparatus for stirring that does not require any substantial reconstruction of the melting furnace and which has to secure the effective jet-mixing of the molten metal in the vessel of the melting furnace. Stirring is achieved in the intermittent regime. The set aim is not reached, because the mass of the molten metal, which may be discarded into the vessel of the furnace in the form of a jet, cannot exceed the capacity of the pipe of the apparatus. Shortcomings of said apparatus are the laboriousness of the removal of slag from the pipe, and the complexity of travel of the pipe of the mechanical drive pump.

According to yet another prior art there is provided a rotary device for treating molten metal, wherein the combination of a chamber, outlets having a larger cross-section than the inlets and cut-outs in the roof and the base, results in both improved degassing and improved mixing of molten metal such that rotation speed can be reduced while maintaining the same efficiency of degassing/mixing, thereby extending the life of the shaft and rotor, or degassing/mixing times can be achieved more efficiently at the same rotor speed, providing an opportunity to reduce treatment time. However, the controlled regulation of the rotational speed in accordance with the viscosity of the molten metal and the dimensions of the chamber, outlets and inlets is a task of difficulties. The vortex formed in the liquid metal and serious turbulence near the liquid surface, result in severe entrapment of gas and other contaminants.

According to the yet another prior art, there is provided a vibrational fluidly stirring apparatus comprising a tank for accommodating fluid; a vibration generating portion containing a vibrator; a vibration absorbing member disposed between the tank and the vibration generating portion; a vibrating bar operationally connected to the vibration generating portion and extended in the tank; and a vibration vane attached to the vibrating bar, wherein the vibration absorbing member comprises a rubber plate or a laminate of rubber plate and metal plate. The performance of the system is depend on vibration absorbing member and the system also have a drawback of scattering the liquid to the outside of the tank as controlled regulation of the vibrational frequency is very difficult.

Current mechanical or electromagnetic stirring for treating liquid metals causes turbulence near the liquid surface which is harmful for most casting processes. Therefore, the stirring speed must be limited in order to achieve a relatively stable liquid surface, and consequently both effectiveness and efficiency of liquid metal treatment are compromised.

For the reasons stated above, which will become apparent to those skilled in the art upon reading and understanding the specification, there is a need in the art for a system and method for liquid metal treatment prior to solidification processing that is scalable and independent/compatible to new technology platforms, uses minimum resources that is easy and cost effectively maintained and is portable and can be deployed anywhere in very little time.

It would be advantageous, therefore, to provide a method and apparatus that can be readily applicable to existing casting processes and can provide intensive melt shearing while avoiding entrapment of gas and other contaminants from the melt surface as well as supply such sheared melt down stream by pressurising the liquid or semi solid slurry/feedstock required for downstream processing.

SUMMARY OF THE INVENTION

The present invention provides a high shear liquid metal treatment device comprising:

a barrel having a longitudinal axis extending between a first end and a second end, and having an opening at its first and second ends;

a rotor shaft mounted centrally through, and parallel to the longitudinal axis of, the barrel;

a plurality of rotor fans mounted along an axial length of the shaft and within the barrel, each rotor fan formed such that its outer end is within a minimum distance of an internal wall of the barrel; and a plurality of stator plates formed on an inner surface of the barrel, the stator plates being located between adjacent rotor fans, each stator plate extending from an inner surface to substantially to the rotor shaft, each stator plate having at least one passage formed therethrough to allow fluid to pass through the plate; and upper and lower surfaces of each stator plate are formed to be within the minimum distance of an adjacent rotor fan;

wherein, the minimum distance is between 10 μm and 10 mm.

The present invention also provides a method of treating liquid metal using the device of the present invention wherein liquid metal is passed through the barrel from the first end to the second end whilst the rotor fans are rotated at a speed between 1 rpm and 50,000 rpm.

That is, the present invention is a device and method for providing treated/conditioned liquid metal as feedstock for further solidification processing of metallic materials, particulate reinforced metal matrix composites (MMCs) and immiscible alloys.

The device and method of the present invention can homogenise chemical compositions, disperse and distribute gas, liquid and solid phases in liquid metals or metal matrix composites (MMCs). Further the device and method can be implemented in various casting process structures. The method of the invention can be implemented as a stand alone or embedded system.

The present invention can be used for liquid metal treatment prior to solidification processing of metallic materials. In particular, the liquid metals can be treated by the present device due to the high shear it can apply. This provides a means to control inclusions and gaseous elements, to homogenise the melt composition and temperature, to enhance kinetics for any chemical reactions or phase transformations involving a liquid phase, to mix materials containing heterogeneous phases, to refine cast microstructures to eliminate/reduce cast defects and to disperse various agents. As a result, the invention is applicable to a variety of casting techniques, such as but not limited to high pressure die casting, low pressure die casting, gravity die casting, sand casting, investment casting, direct chill casting, twin roll casting, and any other casting process which requires liquid metal as a feedstock.

The principal object of the present invention is to provide an apparatus and method for providing treated/conditioned liquid metal or semisolid slurry as feedstock for further solidification processing of metallic materials, particulate reinforced metal matrix composites (MMCs) and immiscible alloys. Another object of the present invention is to provide an apparatus and method that can homogenise chemical compositions, disperse and distribute gas, liquid and solid phases in liquid metals or particles or gases that will react with the metal to form metal matrix composites (MMCs). The apparatus and the method of the present invention may be used to enhance the kinetic conditions for chemical reactions and phase transformations involving at least one liquid phase.

The present invention is advantageous for treating semi-solid slurry of metallic materials. In particular the effect of shear on semisolid slurry is to break up any formed dendrites and thereby ensure that the microstructure is/remains equi-axial. This can be particularly important because the yield stress of a metallic material is inversely proportional to the grain size, which in turn is inversely proportional to the shear rate. Further, if a metal solidifies (even partially) in such an environment the resultant grain structure tends to be equiaxial if the semisolid slurry is subject to sufficient shear for sufficient time.

The present invention is advantageous for treating fully liquid metallic materials. In particular, it can evenly distribute particles within a liquid material thereby providing an even distribution of nucleation sites which can result in a fine and homogenous microstructure in the resulting solid material.

The present invention can be used to produce high quality metallic materials as well as metal matrix composites (MMCs) and metal foams with refined microstructure and reduced cast defects.

The present invention can be used for dispersive mixing under high shear rate and distributive mixing with macroscopic flow in the entire volume of liquid metal without causing serious turbulence near the liquid surface.

The device of the present invention can be used as an inline alloying furnace. Alternatively it may be used as a pump for liquid metal in a foundry environment while at the same time providing sheared, refined material. Alternatively, it may be used as a potential mill to recycle metal. As a further alternative, a device according to the present invention may be used as the pressure provider in an extrusion process by attachment of a simple profiled die to produce extrusions which can also be fed into a set of rollers in a semisolid state for form sheet metal.

The rotation of the rotor shaft and the rotor fans can be achieved in any manner apparent to a person skilled in the art. In some embodiments of the invention the rotation of the shaft and fans may be achieved by supplying fluid to the device under pressure such that as the fluid is forced through the device it acts to rotate the fans and the shaft. In order for this to be achieved the fans will need to be formed in a suitable manner, the skilled person will readily understand the various ways in which the fans could be formed to achieve this result.

Alternatively or additionally, the device of the present invention may further comprise a motor connected to the rotor shaft to rotate the rotor fans. The motor may be directly or indirectly connected to the rotor shaft. The motor may be set on a platform and connected to the rotor shaft to drive the rotor fans.

Generally the device of the present invention will be utilised in an orthodox orientation whereby the first end of the barrel is uppermost when the device is in use. However, it may also be used in alternative orientations. For example, the device may be used in a substantially inverted orientation with the first end of the barrel lowermost and liquid metal pumped upwards through the barrel. This may be preferable if the device is used for degassing and/or for the production of MMRCs. If used in an inverted orientation gas may be bubbled through liquid metal passing through the device thereby forming oxides, carbides, or other inclusions by the reaction of the gas and the liquid metal.

A device according to the present invention may comprise a reservoir formed at the first end of the barrel. A reservoir will be followed by alternating arrangements of stator plates and rotor fans encased within the barrel. The reservoir stage may comprise internal baffles to prevent swirling of liquid metal contained therein. A stator plate may form the lower part of the reservoir and the baffles may be formed to prevent upstream swirl caused by the rotor fan immediately below the stator plate.

The stator plates may be formed in any manner apparent to a person skilled in the art. It may be preferable that each stator plate consists of two halves of a circular plate that are fitted into and held together by the barrel with a hole formed in the middle through which the rotor shaft may run.

The stator plates are generally formed such that they act to convert kinetic energy in a swirling fluid (the liquid metal) to pressure in the fluid as it is forced through the at least one passage formed through the plate.

Each stator plate has at least one passage formed therethrough. It may be preferable that each stator plate has a plurality of holes formed (for example drilled) therethrough to allow liquid metal to pass therethrough. The diameter of the holes may be any suitable size and preferably may be between 0.5 mm and 10 mm. The diameter of the holes in the stator plates may be consistent along the longitudinal length of the barrel or may vary in any appropriate manner. However, it may be preferable that the diameter of the holes reduce along the longitudinal length of the barrel. That is, the diameter of the holes in the stator plates will be determined by the position of the stator plate along the longitudinal axis of the barrel, with plates nearer the first end of the barrel having relatively larger holes than plates nearer the lower end of the barrel.

It is to be understood that the device of the present invention should be formed of materials that do not melt or deteriorate excessively at the temperatures at which the device is intended to be used. As a result, it is preferable that the device is formed from material or materials with a melting point of not less than 200° C., even more preferably not less than 600° C., and most preferably not less than 1000° C. A device formed of materials with such high melting points make it suitable for use in the high temperature environment of liquid metal processing.

Each rotor fan of the present invention preferably comprises at least one blade. Each blade may be formed such that, when rotated, it adds energy to the liquid metal and acts to push it down through an adjacent stator plate.

The high shear produced by the device of the present invention is a result of the minimum distance between each rotor fan and the adjacent stator plates. In particular, the rotor fans being positioned within a minimum distance that is between 10 μm and 10 mm ensures that liquid metal within the device is subject to a high shear when the rotor fans are rotated.

Preferably the device of the present invention additionally comprises a protective housing wherein, the stator plates, the barrel, and the rotor fans are all contained within the housing.

Preferably the device of the present invention comprises a bush. The bush being fixed on the said housing or on the said rotor shaft.

The rotor shaft of the present invention may be threaded so that rotor fans can be easily mounted thereon and held in place using nuts.

The method of the present invention can intensively shear liquid metals either batch wise or continuously using the device of the present invention. This can be done as part of a method of treating a liquid metal that also includes, but is not limited to, degassing of liquid metals, preparing semi-solid slurries, preparing metal matrix composites, preparing metallic foams, mixing immiscible metallic liquids, recycling, alloying, pumping liquid metals, providing conditioned liquid metals for further solidification, or liquid metal processing within existing casting processes.

During operation, the motor can be operated to drive the rotor shaft and thereby rotate the rotor fans between the stator plates. If the fans are formed appropriately, this will cause a negative pressure acting downwards on liquid within the device and a swirling of the liquid. As the liquid is swirling across the stator plates, the liquid metal is sheared due to the small gap in between the rotor fans and the stator plates. The rotor fans may be rotated at high speed and this will cause shearing of the liquid metal as the fans cut through the liquid metal and liquid is forced across the fan.

The rotation of the fans will also push the liquid metal through the at least one passage formed in each stator plate and this will further shear the liquid metal. As the liquid metal passes through a stator plate any swirl element of the flow in the liquid metal is reduced, this results in an increase in pressure across the stator plate.

In some embodiments of the invention the diameter of the barrel may reduce from its first end to its second end. In these embodiments once liquid metal has passed through the at least one passage formed in a stator plate, as described above, it will be forced into a smaller volume that is formed between the stator plate it has passed through and the subsequent stator plate. This is due to the diameter of the barrel decreasing. This increases the pressure of the liquid metal at this stage. After passing through a stator plate the liquid metal is met by another rotor fan and the process set out above is repeated until the liquid metal passes out the lower end of the barrel.

A device according to the present invention will comprise sufficient rotor fans and stator plates such that liquid metal passing through the device will undergo sufficient intensive shearing and be subject to sufficient pressure for the desired treatment of the liquid metal to occur. The necessary shearing and pressure will be determined by the specific intended use of the embodiment of the device.

Each rotor fan may comprise one or more fan blades. Each blade can be parallel to or at an angle with the longitudinal axis of the barrel or they may be curved such that their orientation relative to the longitudinal axis of the barrel varies along their length. The shape of each blade can be a cylinder, square column, prism, and any other geometric bodies either regular or irregular, as long as they can be manufactured and assembled practically. The shape of the individual blades can be different from one another, and the surface of one blade can be flat or curved or combined by different geometric surfaces. A single rotor fan may comprise different shaped blades. The distribution of the blades of a rotor fan around the rotor shaft need not be symmetrical, although it may be preferred. For the purposes of structural stability, especially when considering larger ceramic variants, a rotor fan may comprise an outer peripheral ring that is used to join the outer tips/edges of all the blades of a rotor fan so that structural integrity of the fan is maintained and so that tensile stresses on the blades during use of the device from centrifugal force can be reduced.

Blades of one or more rotor fans of a device according to the present invention may be hollow and formed such that air or another material can be fed through the fans into the liquid metal. Forming rotor fans in this manner would allow air or MMRC particles (or any other suitable material) to be introduced into the liquid metal to enhance the processing of the liquid metal.

The shapes of the holes formed through each stator plate can be round holes, square holes, slots or the like, as long as the liquid metal within the device is sheared efficiently and practically. The preference is generally for round holes of a suitable size. The function of the stator plates is to provide shear as well as to reduce the kinetic energy in the flow of the liquid by converting it to pressure energy and thereby aiding the pressure build up and the transport capability of the device.

The stator plates of the present invention may be comprised of stator blades instead of solid plates to provide shear and to reduce the kinetic energy of the flow thereby converting it to pressure energy. That is, as an alternative to having stator plates formed as solid plates with one or more holes formed therethrough, one or more stator plates may consist of a ring of blades stemming from/attached to/slotted into an inner wall of the barrel. These blades may be shaped to achieve the same function of kinetic energy conversion to pressure energy and to provide high shear. As will be apparent to the person skilled in the art, the shapes of the blades can be a cylinder, square column, prism, and any other geometric bodies either regular or irregular, as long as they can be manufactured and assembled practically. The shape of the individual blades can be different from one another, and the surface of one blade can be flat or curved or combined by different geometric surfaces. Different blades may be used for the same stator plate. The distribution of the blades around a stator plate does not need to be symmetrical. The stator blades can be curved and/or have holes in them. During operation, the motor passes the power to the rotor via the rotor shaft and drives the rotor to rotate between the stator.

If one or more stator plates are formed of blades, when in use liquid metal will pass through the stator plates and between the blades. When in use, due to the small gap in between the rotor fans and the stator plates, liquid metal therebetween is subject to a high shear. A component of outward flow is also produced due to centrifugal force resulting from the rotating rotor fans. Liquid metal influenced by this will be sheared between the outer edges of the rotor fans and the inner barrel wall within the thin gap between the two.

When in use the rotor shaft and the rotor fans of the device of the present invention may be operated at any appropriate speed. Generally, it will be preferably that the rotor shaft will be rotated at a speed between 1 rpm and 50,000 rpm. It is envisaged that the skilled person will be readily able to determine the preferred rotational speed.

One or more rotor fans of a device according to the present invention may comprise an outer peripheral ring, formed around the tips of any blades that form each rotor fan. This construction is beneficial if the rotor fans are formed of ceramic based materials as it allows for simpler construction. It is also particularly suitable for devices that are intended to be used for the processing of more corrosive liquid metals, such as aluminium, and high melting temperature alloys. The presence of an outer peripheral ring may result in a more even transfer of radial stress along a rotor fan.

In some embodiments of the method of the present invention during use a device according to the present invention may be completely immersed in a vat of the material that is being processed.

In some embodiments of the device of the present invention the rotor shaft may extend above the first end of the device (and any reservoir if it is present) and may thereby be supported by a hollow tube to prevent its warping during use.

The internal wall of the barrel of the device of the present invention is substantially cylindrically symmetrical about its longitudinal axis. This allows the outer ends of the rotor fans to be maintained within the minimum distance of the internal wall. The internal wall of the barrel of the present invention may comprise circumferential slots to allow the stator plates to be easily mounted and held therein.

A device according to the present invention may have any suitable cross-sectional profile along its longitudinal axis. It may be preferable that the barrel is widest at is first end and gradually narrows towards its lower end. This may be preferred as it facilitates an increase in pressure in liquid metal as it passes through the barrel. Alternatively, the barrel may have a substantially constant diameter along its longitudinal axis.

As a further alternative the barrel may be shaped like a venturi meter and have a broad-narrow-broad cross-section. As a further alternative, the barrel may be shaped in the opposite manner with a narrow-broad-narrow cross-section. Both of these cross-sections may compress and expand liquid passing through the device thereby providing a cyclic variation in pressure which can be exploited to enhance shear/mixing/process time.

In some embodiments of the device of the present invention the rotor fans and/or the stator plates will be formed to draw liquid through the device as the rotor fans are rotated. In these embodiments the device may be operated with the opening at the first end located immersed in liquid metal such that liquid metal is automatically drawn into the device through the opening.

In some embodiments of the invention one or more rotor fans may be formed of two sets of blades that are longitudinally spaced from one another. Similarly, one or more stator plates may be formed from two longitudinally spaced flat plates. Rotor fans and stator plates formed in this manner may provide a more intense pressure build up and then diffusion of flow.

In some embodiments of the invention the rotor fans can be arranged around and along the rotor shaft in a spiral configuration and the stator plates can be arranged around the internal wall of the barrel in a cooperative spiral configuration. As will be readily appreciated, in order to achieve this each stator plate and each rotor fan can not be completely circular and instead must only extend a portion of the way around the rotor shaft. Nevertheless, in a direction along the longitudinal axis of the barrel the rotor fans and the stator plates remained alternately positioned.

The barrel of the present invention may be constructed in any way apparent to a person skilled in the art. For example, the barrel may be constructed in two separate halves that are subsequently joined together to assemble the barrel. This may be achieved using holding rings: a first holding ring formed around the barrel at or near its first end and a second holding ring formed around the barrel at or near its second end. Alternatively, the two halves may simply be bolted tightly together and a seal between the two halves may be achieved using a simple flange that is bolted.

Furthermore, as set out above, the barrel may be contained within a housing such that in the case of any breakage of the barrel parts liquid metal remains contained in the housing.

In some embodiments of the invention the device may further comprise one or more heaters external to, or integral with, the barrel in order to control the temperature of material within the barrel (for example ensuring the correct temperature gradient of the material within the barrel). Heaters may be formed in any manner apparent to the person skilled in the art.

The materials from which a device according to the present invention are will have to satisfy material requirements that will be immediately apparent to a person skilled in the art. These requirements include but are not limited to:

- They should be of high strength and high durability at the temperatures at which the device is used;
- They have to be corrosion resistant to withstand the corrosive nature of the liquid metals with which they are used;
- They have to be feasible to manufacture using available manufacturing techniques; and
- They have to be of a suitable cost.

Ceramics, graphite, steels, high temperature alloys and any other materials could be used for manufacturing the high shear devices as long as they have enough strength and chemical stability at the desired temperature, which is defined by the liquid metal with which the device is used. For example, nickel-free high temperature steels are the preferred materials for construction of the said high shear devices for treating/conditioning of liquid magnesium alloys. Graphite, molybdenum coated with M0S12 and ceramics are preferred materials for construction of the said high shear devices for treating/conditioning of aluminium alloys. Suitable ceramic materials include, but are not limited to, nitrides, silicides, oxides, carbides, sialon and other mixed ceramics. Particularly preferred ceramics include silicon carbide, aluminium oxides, boron nitride, silicon nitride and sialon. It is noted that graphite is one of the suitable materials for bushes in all embodiments of the present invention.

The device of the present invention has many applications. It is particularly useful as a high shear pump for supplying conditioned liquid metal to a variety of casting processes such as rolling extrusion drawing etc The device of the present invention may also be integrated into a melting furnace or a holding furnace to supply conditioned liquid metal to a continuous ingot casting machine for the production of high quality ingots. The said ingots may contain well dispersed oxide particles and have self grain refining power, and can be used as a feedstock for the casting house for high quality castings.

The device of the present invention may be integrated in a melting furnace or a holding furnace to supply conditioned liquid metal to a continuous (or semi-continuous) casting process. The said continuous process includes, but is not limited to, twin roll casting for thin strips, direct chill casting for ingots and slabs, up-casting for rods and any other continuous (or semi-continuous) casting process which requires liquid metal as a feedstock. The supply rate of the said conditioned melt can be controlled by varying the rotor speed and the design of the rotor fans and/or stator plates of the device.

The device of the present invention may be integrated in a melting furnace or a holding furnace to supply conditioned liquid metal to a shape casting process to produce shaped components. The said shape casting process include, but are not limited to, high pressure die casting, low pressure die casting, gravity die casting, sand casting, investment casting and any other shape casting processes which requires liquid metal as a feedstock. The dosing of the said conditioned melt can be controlled by varying the rotor speed and the design of the rotor fans and/or stator plates of the device.

The device of the present invention can be used to produce liquid metals within the following characteristics. The examples are purely illustrative and are not comprehensive.

The device can produce conditioned liquid metal with low gas content, well dispersed oxide films and other inclusions, uniform temperature and homogeneous chemical composition, as a feedstock suitable for solidification processing with a variety of casting processes.

The device can be used for grain refinement, for facilitating the casting process and for improving the quality of the cast products. For example, the device can be but directly implemented into a direct chill casting and twin roll casting processes for promoting equiaxial solidification and into shape casting processes as a dosing pump to provide directly conditioned liquid metal.

The device can be used to disperse and distribute gas, liquid and discrete solid phases into a liquid matrix, such as degassing with high efficiency, mixing immiscible metallic liquids to produce finely dispersed microstructures, producing metal matrix composites with well dispersed and uniformly distributed fine solid particles, and enhancing chemical reactions between hetero phases.

The device can be used to pump molten metal in a foundry environment. The device can be used as an inline alloying furnace. The device can be used to effectively recycle scrap metal. The device can be used to provide upstream pressure for a range of retrofitable semisolid shaping methods including extrusion, rolling, drawing of wires casting of billets and plates.

The device can be used to disperse effectively and distribute uniformly solid particles, liquid droplets and gas bubbles in liquid metals. The device can be used to reduce the size of solid particles, liquid droplets or gas bubbles in liquid metals. The device can be used to improve the homogenisation of chemical composition and temperature field in liquid metals.

The device can be used to provide physical grain refining to metals and alloys by activating both endogenous and exogenous solid particles in the liquid metals, resulting in a significant grain refinement of the metallic materials. The device can be used to enhance the kinetic conditions for chemical reactions and phase transformations involving at least one liquid phase.

The present invention may be better understood from the preferred embodiments that are illustrated in the drawings and are described below.

DRAWINGS

FIG. 1 comprises schematic illustrations of a first embodiment of a device according to the present invention and its component parts;

Figure 1:
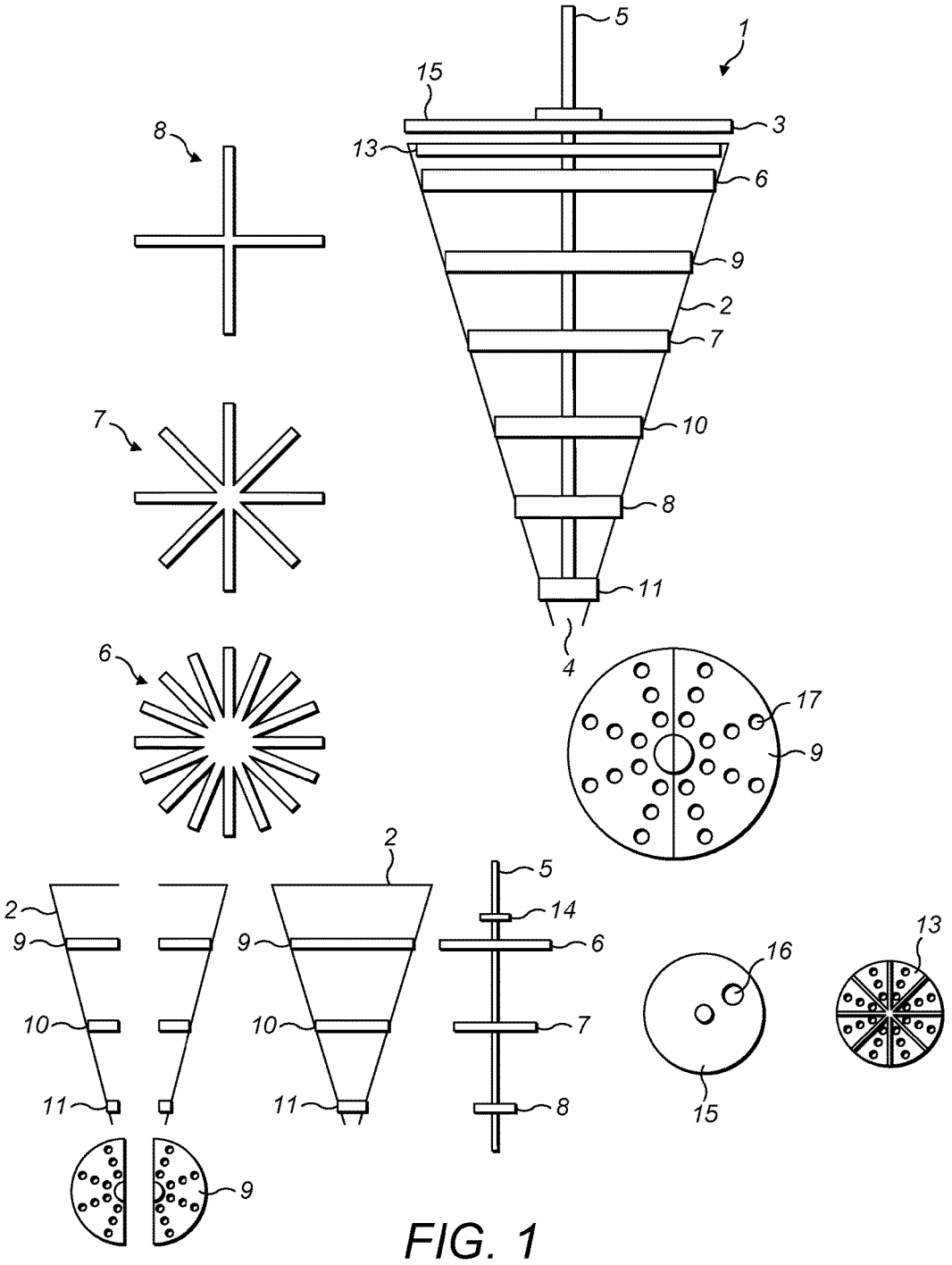

An embodiment of a device 1 according to the present invention and its component parts is schematically illustrated in FIG. 1. The device 1 comprises a barrel 2 having an upper end 3 and a lower end 4 and a longitudinal axis extending therebetween. The diameter of the barrel 2 decreases at a constant rate between its upper end 3 and its lower end 4 such that the barrel 2 is an inverted truncated cone.

A rotor shaft 5 extends through the barrel 2 between the upper and lower ends 3, 4 along the longitudinal axis. Three rotor fans 6, 7, 8 are mounted on the rotor shaft 5. Three stator plates 9, 10, 11 are mounted on an internal wall of the barrel 2 and extend from the internal wall to the rotor shaft 5. A reservoir 12 is formed at the upper end 3 of the barrel 2 above the upper rotor fan 6. The reservoir 12 contains a baffle 13 to prevent liquid swirling within the reservoir and has a plate 15 mounted at its upper end. The plate 15 forms the upper end of the reservoir 12 and has an opening 16 formed therein to allow liquid metal to enter the reservoir. A bush 14 is mounted on the rotor shaft 5 near its upper end.

Details of each rotor fan 6, 7, 8 are shown in FIG. 1. The upper rotor 6 consists of sixteen substantially flat rotor blades, the middle rotor fan 7 consists of eight substantially flat rotor blades, and the lower rotor fan 8 consists of four substantially flat rotor blades. The rotor blades of each fan are aligned with the rotor shaft 5 and are equally circumferentially spaced about the rotor fan 6, 7, 8. The rotor fans 6, 7, 8 are formed such that the radially outer end of each blade is positioned within a minimum distance of the internal wall of the barrel 2 and such that the upper and lower surfaces of each blade are positioned within the minimum distance of the adjacent stator plates 9, 10, 11. The minimum distance is less than 10 mm. It will be readily understood that, as FIG. 1 is a schematic diagram, the gap between the stator plates 9, 10, 11 and the rotor fans 6, 7, 8 is exaggerated in the Figure.

FIG. 1 also shows the details of the stator plates 9, 10, 11. The stator plates comprise substantially flat plates with a plurality of holes 17 formed therethrough. The holes allow liquid metal to pass through the plates 9, 10, 11. FIG. 1 also shows details of the baffle 13. The baffle 13 comprises a plate with a plurality of holes formed therethrough a number of vertical blades extending from a surface of the baffle 13 to prevent liquid swirling within the reservoir. As shown in the lower left corner of FIG. 1, the barrel 2 and the stator plates 9, 10, 11 are formed in two halves that are then secured together.

In use, liquid metal is provided into the device 1 through the hole 16 in the upper plate 15. This liquid metal enters the reservoir 12 and then passes through the baffle 13 and the upper stator plate 9 and enters the barrel 2. The liquid metal can then pass through the device 1 before leaving the barrel 2 at its lower end 4. During its passage through the device 1 the rotor shaft 5, and thereby the rotor fans 6, 7, 8 are rotated at a speed between 1 rpm and 50,000 rpm. This acts to shear the metal between the rotor blades and the internal wall of the barrel or between the rotor blades and the stator plates 9, 10, 11. As the rotor blades are within the minimum distance of both the internal wall and the stator plates 9, 10, 11 the liquid metal is subject to high shear and is processed.

Figure 2:
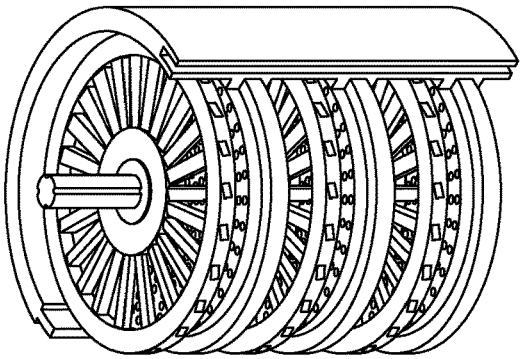
FIG. 2 is a schematic illustration of a second embodiment of a device according to the present invention.
Figure 2:
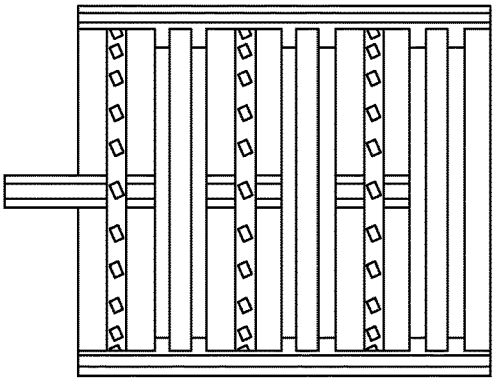
Figure 2:
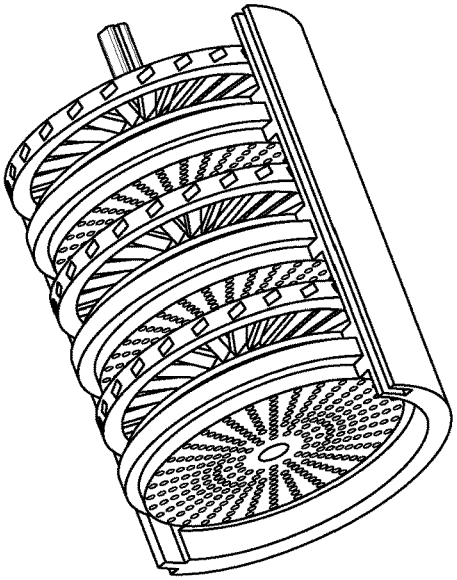

An alternative embodiment of a device 1 according to the present invention is shown in FIG. 2. The device 1 of FIG. 2 is similar to and operates according to the same principles as the device of FIG. 1, as such the same components of the device 1 are labelled using the same reference numerals where appropriate and will not be explained in detail except for where there are significant structural differences.

The device 1 of FIG. 2 differs from the device 1 of FIG. 1 in that the barrel 2 is substantially cylindrical and has a constant diameter along its longitudinal axis. As a result each of the stator plates 9, 10, 11 are identical to one another and each of the rotor fans 6, 7, 8 are identical to one another. Further, the stator plates 9, 10, 11 are formed of a plurality of equally circumferentially spaced blades with passages formed between adjacent blades. The blades are flat and are at an angle to the longitudinal axis of the barrel 2. The rotor fans 6, 7, 8 are formed in a similar manner although they comprise fewer blades and the passages between the blades are larger as a result. Both the rotor fans 6, 7, 8 and the stator plates 9, 10, 11 have a radially outer ring that acts to support the blades. The blades of the rotor fans 6, 7, 8 are formed to draw liquid metal through the barrel 2 when the device 1 is in operation.

Figure 3:
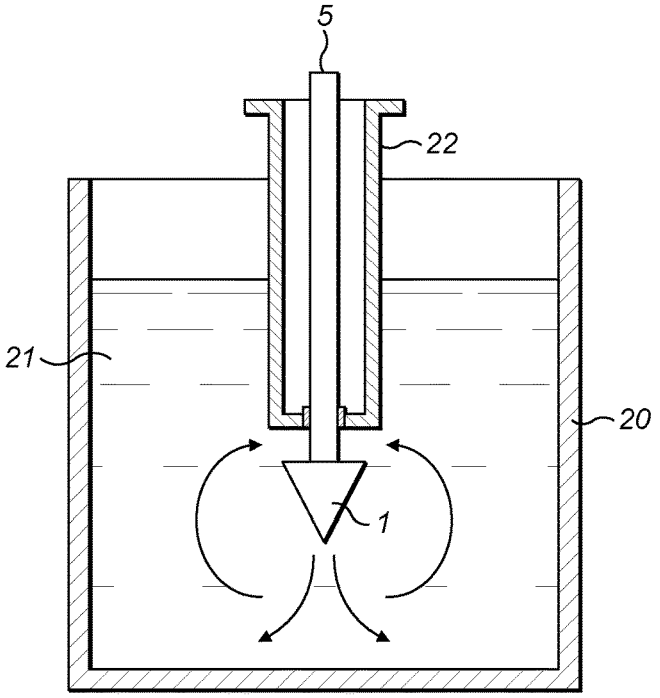
FIG. 3 is a schematic illustration of a liquid metal conditioning process using the device of FIG. 1.
Figure 4:
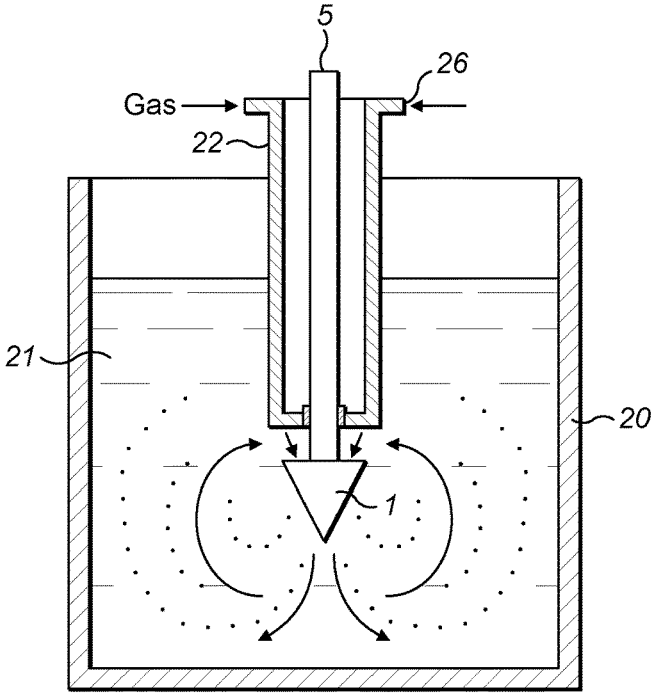
FIG. 4 is a schematic illustration of a liquid metal degassing process using the device shown of FIG. 1.
Figure 5:
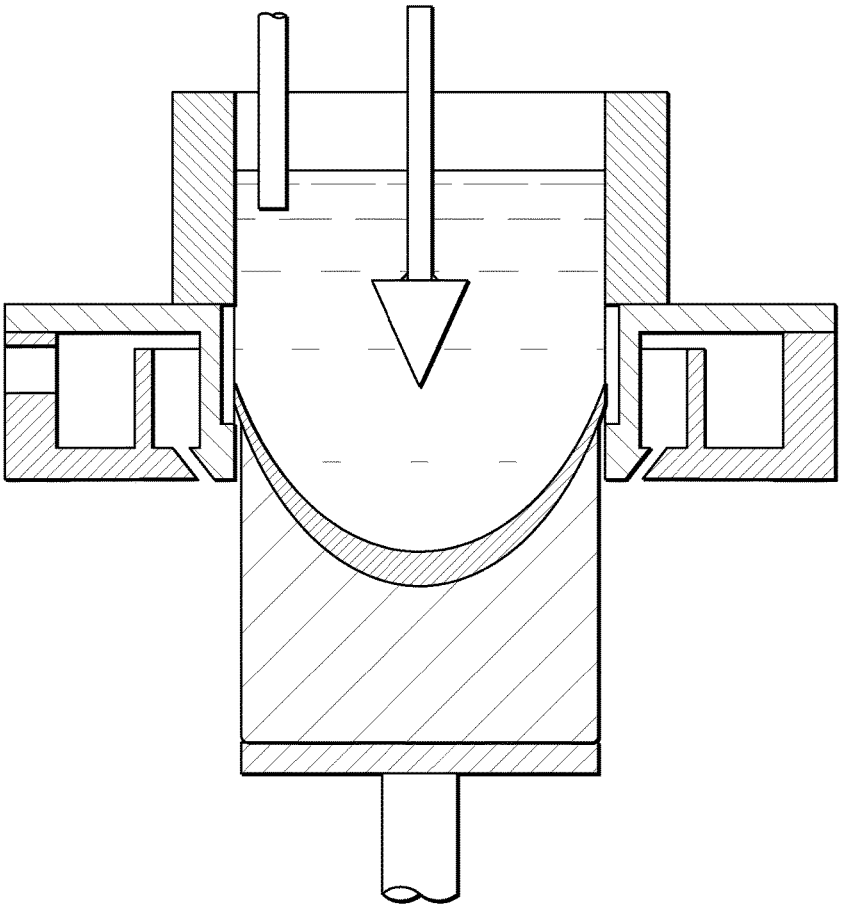
FIG. 5 is a schematic illustration of a direct chill (DC) casting process integrating a conventional DC casting process with the device of FIG. 1.

FIGS. 3, 4, and 5 show potential applications of a device 1 according to the embodiment of FIG. 1. In these Figures the device 1 is schematically represented by a triangle. FIG. 3 is a schematic illustration of a liquid metal conditioning process using the device 1. FIG. 4 is a schematic illustration of a liquid metal degassing process using the device 1. FIG. 5 is a schematic illustration of a direct chill casting process using the device 1. The skilled person will readily understand the conventional manner in which each of these processes are typically carried out so that will not be repeated here. Rather, the implementation of the use of the device 1 of the present invention will be explained with reference to each of the relevant processes.

In the process shown in FIG. 3 the device 1 is fixed on an adjustable platform 22 and the rotor shaft 5 is driven by a motor (not shown). The position of the device 1 is controlled such that it is partially immersed in liquid metal 21 contained in a crucible 20 by adjusting the position of the platform. The crucible 20 is heated to keep the liquid metal 21 at a desired temperature.

During operation, liquid metal 21 is drawn into the device through its upper end by the rotation of the rotor fans and is subject to high shear. The liquid metal 21 then exits the device 1 from its lower end. The passing of the liquid metal 21 through the device 1 by the action of the rotor fans results in a macroscopic flow pattern in the crucible as indicated by the arrows in the Figure. This macroscopic flow delivers the liquid metal 21 to the device 1 such all the liquid metal in the crucible 20 will be subjected to repeated high shear treatment. In addition the macroscopic flow also promotes spacial uniformity of both melt temperature and chemical composition.

This high shear treatment disperses oxide clusters, oxide films and any other metallic or non-metallic inclusions present in the liquid metal 21. The macroscopic flow distributes dispersed particles uniformly throughout the liquid metal 21. It should be pointed out that the macroscopic flow in the crucible 20 will be weak near the surface of the liquid metal 21, and consequently, the macroscopic flow will maintain a relatively undisturbed melt surface, avoiding the possible entrapment of gas, dross or any other potential contaminants in the liquid metal 21. This makes the conditioned liquid metals particularly suitable for manufacturing high quality castings.

The process of FIG. 3 can also disperse exogenous solid particles into the liquid metal 21. Exogenous solid particles can be grain refiner particles, ceramic particles for metal matrix composites (MMCs) or nano particles for production of nano metal matrix composites (NMMCs). The device 1 will disperse the solid particles, distribute the dispersed solid particles uniformly in the liquid metal, and force the solid particles to be wetted by the liquid metal 21.

The process of FIG. 3, can be used to treat liquid metals either above the alloy liquidus to condition liquid metal or below the alloy liquidus to make semi-solid slurry. When treating liquid metal 21 above liquidus, the process can increase potential nucleation sites by dispersing oxide films and/or clusters into individual particles, improving the wettability and spacial distribution in the liquid metal. This is very helpful for grain refinement without addition of any chemical grain refiners. This is referred to as physical grain refinement. When treating the metals below their liquidus, the process can provide semisolid slurry with solid particles of fine size and a narrow size distribution. In addition, the said apparatus and method can provide high quality semi-solid slurry in large quantities.

Liquid metal 21 conditioned by the process of FIG. 3, treated either above or below the alloy liquidus, can be supplied batch-wise or continuously to a specific casting process, for example high pressure die casting, low pressure die casting, gravity die casting, sand casting, investment casting, direct chill casting, twin roll casting, or any other casting process which requires liquid or semi-solid metal as a feedstock.

In the process shown in FIG. 4 is identical to the process of FIG. 3 with the exception that tubes 26 for inputting gas into the liquid metal 21 are formed through the platform 22 such that an end of each tube is located immediately above the device 1. For the purpose of degassing the liquid metal 21, inert gas, such as argon, nitrogen or the like, is introduced into the liquid metal through the tubes 26 such that it enters the liquid metal 21 immediately above the device.

During operation of the process both the liquid metal 21 and the gas are drawn through the device 1 in the same manner as the process of FIG. 3. This subjects the liquid metal 21 and the gas to high shear and produces a macroscopic flow of the liquid metal 21. This disperses large inert gas bubbles into much smaller inert gas bubbles. Further, the macroscopic flow can distribute the inert gas bubbles uniformly throughout the liquid metal 21 in the crucible 20, creating significantly increased gas/liquid interfacial area. The dissolved gas in the liquid metal 21 will diffuse to the inert gas bubbles due to the much lower partial pressure in the inert gas than in the liquid metal 21. Due to their buoyancy, and with the assistance of the macroscopic flow, the inert gas bubble containing the dissolved gas will escape from the melt surface of the liquid metal 21, resulting in significantly reduced gas contents in the liquid metal.

When degassing using the process of FIG. 4, the size of the inert bubbles in the liquid metal can be controlled by varying the specific embodiment of the device 1 that is used. In particular the following parameters will affect the size of the inert bubbles: the minimum distance of the device 1, the size and shape of the passages in the stator plates, the speed at which the rotor fans and rotor shaft are rotated, the number of rotor fans and stator plates, the size, shape and construction of the rotor fans, and the size and shape of the barrel.

The process of FIG. 4 can also be used to prepare metal matrix composites (MMCs) by replacing the input inert gas with ceramic powders such as silicon carbide, aluminium oxide or the like. The high shearing applied by the device 1 of the present invention can improve the uniformity and the wettability of the particles, which is very important for preparing high quality MMC materials.

The process of FIG. 4 can also be used to prepare in situ metal matrix composites (MMCs) by changing the input inert gas to a reactive gas to form reinforcing particles in situ. One example is introducing oxygen to liquid aluminium alloy to prepare alumina particle reinforced aluminium MMCs.

The process of FIG. 4 can also be used to mix immiscible metals by changing the input inert gas to a liquid metal which is immiscible with the liquid metal 21 in the crucible 20. The process can disperse and distribute the immiscible metallic liquids uniformly.

The process of FIG. 4 can also be modified by using a hollow rotor shaft 5 to introduce the inert gas, the ceramic particles, the immiscible liquid metals or the like to the liquid metal 21 for the purpose of degassing, preparing MMCs, mixing immiscible metallic liquids or the like.

FIG. 5 shows a schematic diagram of a direct integration of a conventional direct chill (DC) casting process with the device 1 of the present invention, forming a high shear DC casting process. The high shear device 1 is fixed on an adjustable platform (not shown) for positioning. It is assumed that the features of a conventional DC casting process will be well-known to a person skilled in the art so they will not be repeated here. The device 1 is submerged into the sump of the DC caster. The preferred location of the bottom of the device 1 is 0-300 mm above the mushy zone.

During DC casting, liquid metal is continuously supplied to the DC mould through a feed tube and continuously sheared by the device 1 of the present invention. Liquid metal containing rejected solute elements and solid particles in the mushy zone is sucked into the device from the solidification front, subjected to intensive shearing and then forced out. The intensively sheared melt generates a macroscopic flow pattern in the sump of the DC caster in the same manner as the processes described above. The macroscopic flow pattern causes the homogenisation of temperature and chemical composition in the liquid metal around the device 1. This creates a unique solidification condition in the sump of the DC caster, resulting in a cast ingot with a fine and uniform microstructure, uniform chemical composition and reduced/eliminated cast defects.

Figure 6:
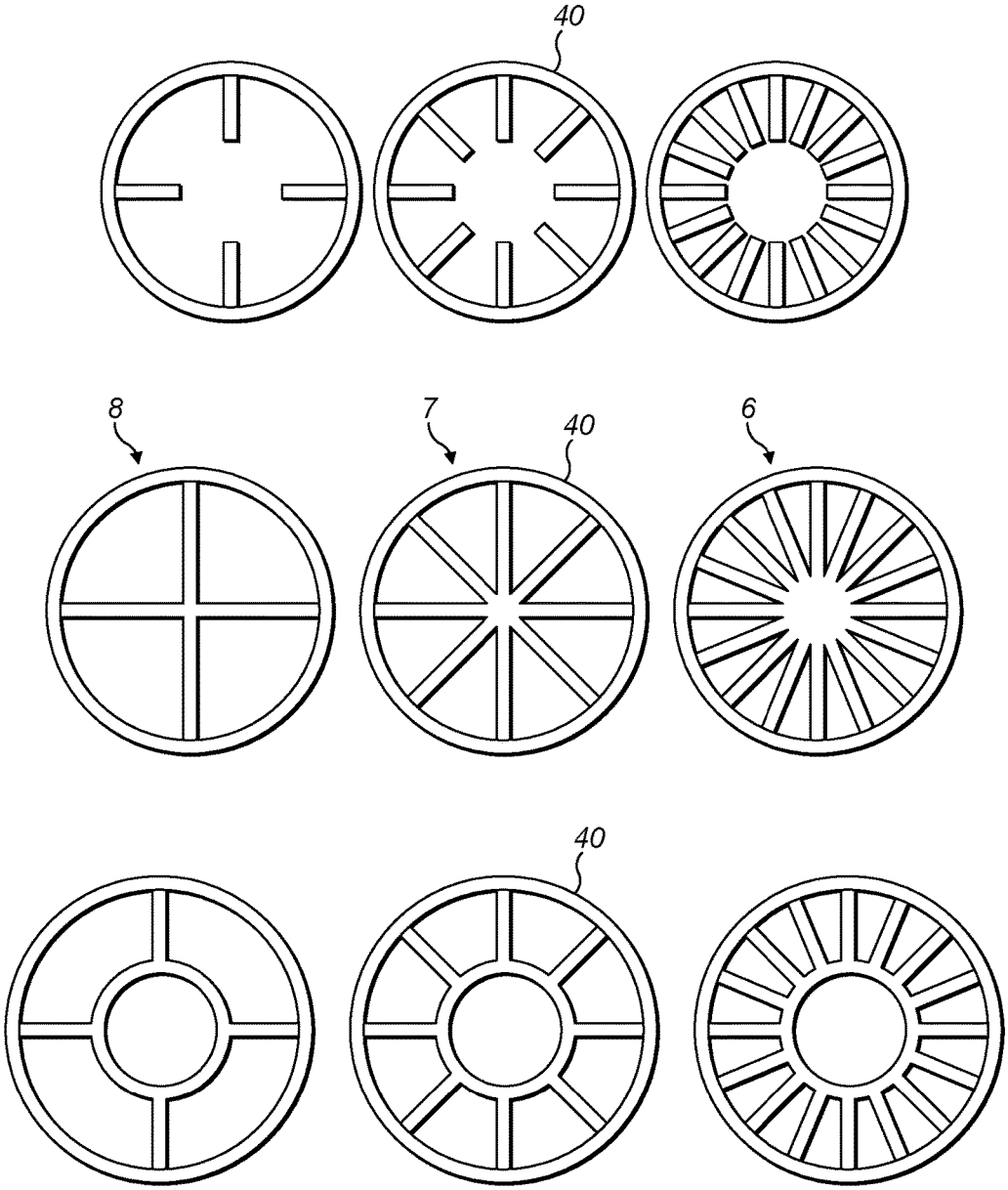
FIG. 6 shows schematic illustrations of various rotor fans and stator plates of embodiments of the device of the present invention.

FIG. 6 shows a number of stator plates 9, 10, 11 and rotor fans 6, 7, 8 that may form part of a device according to the present invention. The stator plates 9, 10, 11 and rotor fans 6, 7, 8 are substantially the same as those of the device 1 shown in FIG. 1 but further comprise a peripheral ring 40 that is formed round their outer radial edges. This outer ring 40 provides structural reinforcement for the stator plates 9, 10, 11 and rotor fans that may be necessary in some embodiments of the invention.

The invention claimed is:

1. A high shear liquid metal treatment device comprising:

a barrel having a longitudinal axis extending between a first end and a second end, and the barrel having respective openings at the first end and the second end;

a rotor shaft mounted centrally through the longitudinal axis and parallel to the longitudinal axis;

a plurality of rotor fans mounted along an axial length of the rotor shaft and within the barrel, each rotor fan formed such that its outer end is within a minimum distance of an internal wall of the barrel;

a plurality of stator plates formed on an inner surface of the barrel, the plurality of stator plates being located between adjacent rotor fans, each of the plurality of stator plates extending from an inner surface substantially to the rotor shaft, each of the plurality of stator plates having at least one passage formed therethrough to allow fluid to pass through the plurality of stator plates; and upper and lower surfaces of each of the plurality of stator plates are formed to be within a minimum distance of an adjacent rotor fan, wherein the minimum distance of the adjacent rotor fan is between 10 μm and 10 mm; and a reservoir formed at the first end, wherein the reservoir comprises internal baffles positioned to prevent swirling of liquid metal contained therein.

2. The high shear liquid metal treatment device of claim 1, wherein the barrel has a decreasing diameter from the first end to the second end.

3. The high shear liquid metal treatment device of claim 1 wherein a diameter of the barrel at the first end and a diameter of the barrel at the second end are the same and the diameter of the barrel varies therebetween.

4. The high shear liquid metal treatment device of claim 1, wherein the plurality of stator plates are substantially circular and are formed of two halves of a circular plate.

5. The high shear liquid metal treatment device of claim 1, wherein the plurality of stator plates are discs having at least one hole formed therethrough to allow fluid to pass through at least one of the plurality of stator plates.

6. The high shear liquid metal treatment device of claim 5, wherein a diameter of the at least one hole is between 0.5 mm and 10 mm.

7. The high shear liquid metal treatment device of claim 5, wherein each of the plurality of stator plates has a plurality of holes formed therethrough.

8. The high shear liquid metal treatment device of claim 5, wherein a diameter of the at least one hole formed through the plurality of stator plates reduces along the longitudinal axis of the barrel.

9. The high shear liquid metal treatment device of claim 1, wherein one or more of the plurality of stator plates comprises a ring of blades.

10. The high shear liquid metal treatment device of claim 1, further comprising a motor connected to the rotor shaft to rotate the rotor fans.

11. The high shear liquid metal treatment device of claim 1, wherein the device is substantially formed of materials with a melting point of not less than 200° C.

12. The high shear liquid metal treatment device of claim 1, wherein the device is substantially formed of materials with a melting point of not less than 600° C.

13. The high shear liquid metal treatment device of claim 1, wherein the device is substantially formed of materials with a melting point of not less than 1000° C.

14. The high shear liquid metal treatment device of claim 1, wherein the barrel is formed of two halves that are bolted together and wherein the two halves are sealed using a flange.

15. The high shear liquid metal treatment device of claim 1, wherein the first end is located above the second end such that passage of fluid from the first end to the second end is aided by gravity.

16. The high shear liquid metal treatment device of claim 1, wherein the rotor fans are formed such that when the rotor shaft is rotated, the rotor fans may operate to draw fluid from the first end to the second end.

17. The high shear liquid metal treatment device of claim 1, wherein the barrel is encased in a protective housing.

18. A method of treating molten material comprising:

rotating a plurality of rotor fans to draw molten material into a liquid metal treatment device though a first end of a barrel, wherein the plurality of rotor fans are mounted along an axial length of a rotor shaft mounted centrally through a longitudinal axis of a barrel, wherein the barrel extends between the first end and a second end, and the barrel comprises respective openings at the first end and the second end, and parallel to the longitudinal axis, and within the barrel, each rotor fan formed such that its outer end is within a minimum distance of an internal wall of the barrel; and passing the molten material through the barrel from the first end to the second end whilst the plurality of rotor fans rotate at a speed between 1 rpm and 50,000 rpm;

wherein a plurality of stator plates are formed on an inner surface of the barrel, the plurality of stator plates being located between adjacent rotor fans, each of the plurality of stator plates extending from an inner surface substantially to the rotor shaft, each of the plurality of stator plates having at least one passage formed therethrough to allow fluid to pass through the plurality of stator plates, wherein upper and lower surfaces of each of the plurality of stator plates are to be formed within a minimum distance of an adjacent rotor fan, wherein the minimum distance of the adjacent rotor fan is between 10 μm and 10 mm, and wherein a reservoir is formed at the first end, wherein the reservoir comprises internal baffles positioned to prevent swirling of molten material contained therein.

* * * * *